United States Patent [19]

Raybuck

[11] Patent Number: 4,511,131

[45] Date of Patent: Apr. 16, 1985

[54] METHOD AND APPARATUS FOR ALIGNING AND TRIMMING OVERLAPPED SIGNATURES

[75] Inventor: William B. Raybuck, Cocoa, Fla.

[73] Assignee: Trimmer Machine Co., Inc., Dorset, Vt.

[21] Appl. No.: 543,362

[22] Filed: Oct. 19, 1983

[51] Int. Cl.[3] ..... B65H 43/02

[52] U.S. Cl. ..... 270/54; 83/88

[58] Field of Search ..... 270/54, 21.1; 101/226–227; 198/626, 627, 628, 462; 83/925 A, 88, 86

[56] References Cited

U.S. PATENT DOCUMENTS

| | | | |
|---|---|---|---|
| 4,040,617 | 8/1977 | Walkington | 83/88 |
| 4,076,231 | 2/1978 | Kutzner et al. | 270/54 |
| 4,079,644 | 3/1978 | Hoke et al. | 83/88 |
| 4,139,980 | 2/1979 | Larson et al. | 83/86 X |
| 4,376,531 | 3/1983 | Breunig | 83/88 |

FOREIGN PATENT DOCUMENTS

| | | | |
|---|---|---|---|
| 2258354 | 2/1974 | Fed. Rep. of Germany | 83/88 |

*Primary Examiner*—E. H. Eickholt

*Attorney, Agent, or Firm*—Mason, Kolehmainen, Rathburn & Wyss

[57] ABSTRACT

A signature aligning and trimming apparatus wherein a stream of overlapping signatures are conveyed past first and second alignment stations on a lower conveyor belt system. Immediately after the second alignment, and while the signatures are still carried by the lower conveyor belt system, the signatures are engaged by an upper conveyor belt system and are pressed firmly against the lower belts as they are moved over large diameter rollers. The edges of the signatures are trimmed by single cutting wheels positioned to engage the edges of the signatures as they move over the top of the large diameter rollers. A pair of anvil plates, which are positioned beneath the cutting wheels and are rotatable with the large diameter rollers, provide a supporting surface for the signature edges against which the cutting wheels act in trimming the signature edges.

56 Claims, 10 Drawing Figures

Fig. 8
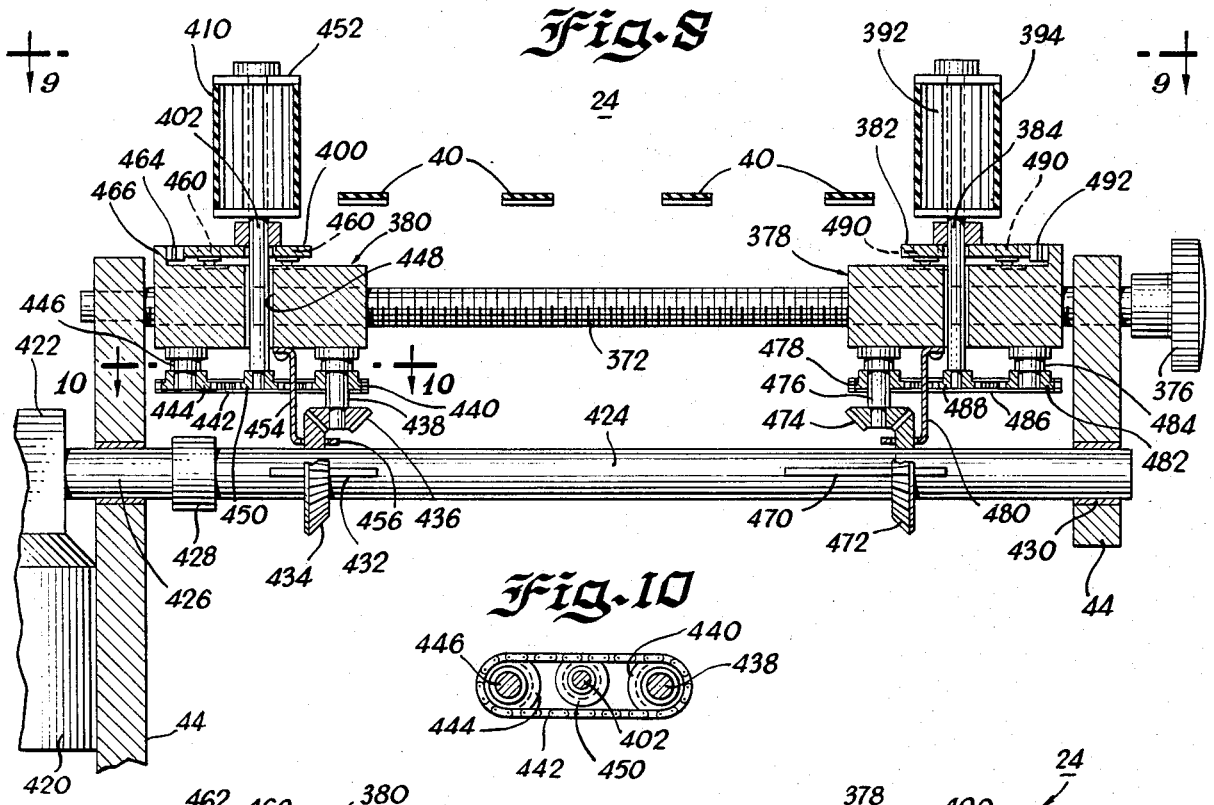
Fig. 10
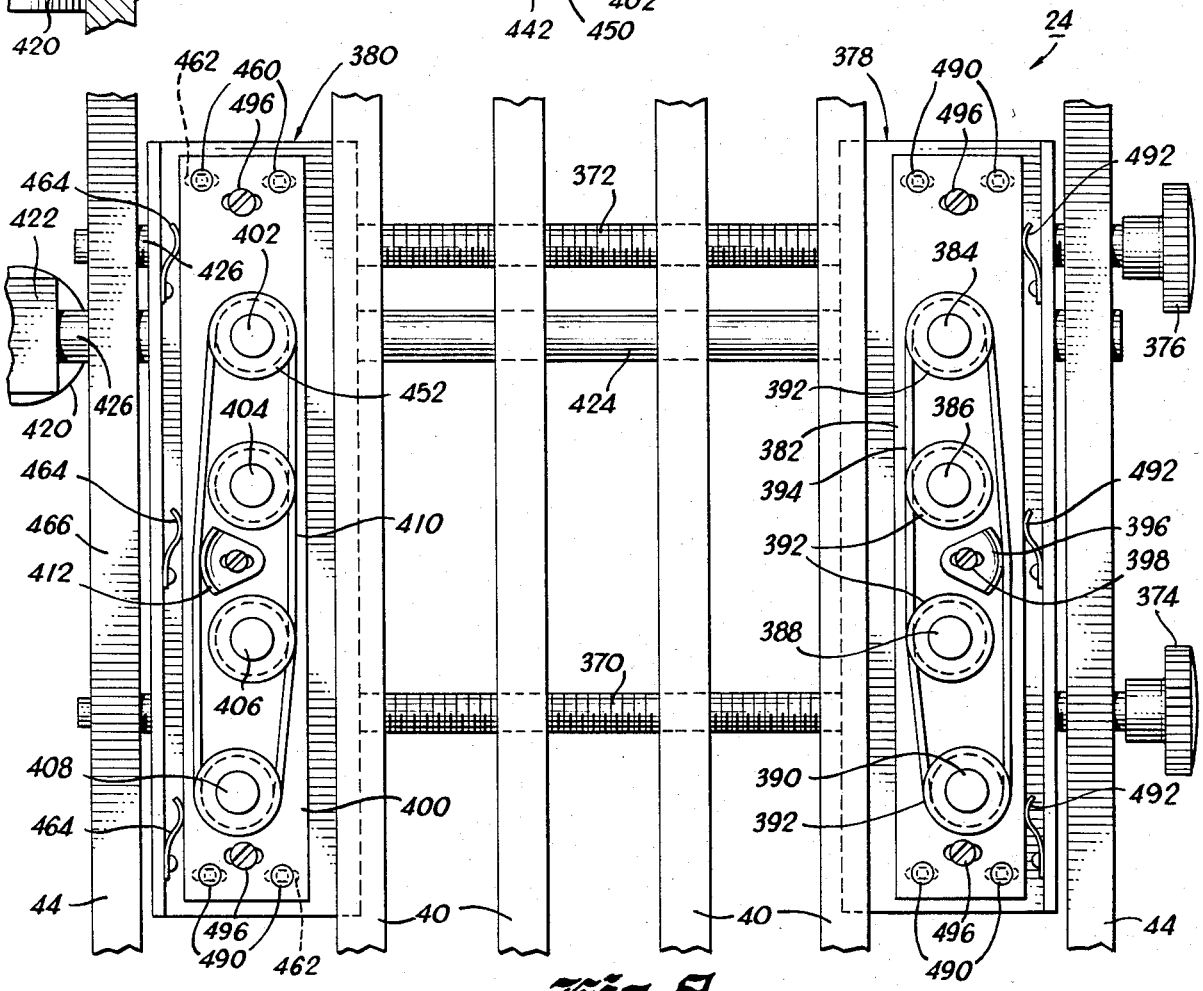
Fig. 9

METHOD AND APPARATUS FOR ALIGNING AND TRIMMING OVERLAPPED SIGNATURES

The present invention relates to methods and apparatus for aligning and trimming folded printed paper booklets commonly known as signatures, which are supplied in a continuous shingled, i.e. overlapping, stream from a preceding web press, combination folder or flow folding station.

Various arrangements have been heretofore proposed for aligning and trimming a continuous stream of shingled signatures. In general, these arrangements involve a series of smooth belts which hold the signatures between them as they move past a trimming station. These belts are driven by friction rollers and must be highly tensioned in order to grip the signatures and move them past the cutting wheels of the trimming station. However, when the signatures are flowing at a high rate of speed, such as 30,000 signatures per hour, and the preceding press or folding stations malfunctions the signatures may bunch up and in attempting to pass through the trimmer will cause either one or more of the belts to break. In some instances, the belts in prior trimming apparatus have been broken twice in a single eight hour shift of operation. If the tension on these belts is reduced in an effort to reduce such breakage the signatures are not held firmly as they pass by the cutting wheels and non parallel or uneven cuts are produced. Also, as the tension is reduced to avoid breakage the variation in cut register increases due to movement of the signatures as they flow past the cutting wheels. With many prior art arrangements the variation in width is greater than $\pm\frac{1}{8}$ of an inch, a condition which is accepted with great dissatisfaction in the industry.

A further disadvantage of prior art signature trimming apparatus in that this equipment usually trims each edge of the signature stream by passing if through opposed overlapping cutting wheels which trim the edge by a scissors type action. Since the edge of the signatures is not held against a surface while it is cut, there is difficulty in maintaining a straight cut and the trimmed edges may have an undesired ripple effect.

The stream of signatures from the printing press or folding station are usually considerably out of alignment. Accordingly, it is necessary to employ apparatus, commonly known as a jogger, to align the signatures before they are fed to the trimming apparatus. As stated heretofore, signatures consist of sheets of paper upon which images have been placed by a web press after which the sheets of paper are folded in half a number of times. One side of the final signature will contain nested folds and the side adjacent to it will have independent folds. When the folder makes a series of folds on a sheet of paper air tends to become trapped within the folds and the folder is usually arranged to perforate the folds which are independent so that air can escape and the signature will lie flatter. The side wherein the folds are nested is called the spline and forms the back of the signature. At right angles to the spline are the independent folds which are perforated. The other two sides of the signature include loose sheets of paper, are never in alignment, and also lack rigidity. Accordingly, signatures are always aligned either against the spline or the side with the independent folds. However, when the top and bottom of the signature is trimmed, as in conventional two knife trimmers, the spline is positioned at right angles to the direction of flow and hence the signature can only be aligned against the independent fold side.

Conventional jogging apparatus employs a fixed slide plate on one side of the signature stream and a pivoted jogger plate on the other side which is pivoted back and forth so that it alternately slightly compresses the signature flow against the fixed slide plate and them releases the signature flow to provide a rough alignment of the overlapped signatures. Since the pivoted jogger plate strikes the edge of the signature stream at a slight angle it inherently creates disturbances within the signature flow and causes the signature to bounce back slightly from the fixed plate in random fashion. As a result the best tolerance which can be achieved with this type of apparatus is only $\pm\frac{1}{8}$ of an inch and this tolerance is oftentimes exceeded. If more precise alignment is desired it is customary to use a second similar jogging apparatus on which the pivoted jogger plate has a reduced swing and is moved back and forth more slowly so that it engages a signature a fewer number of times. However, the folded signatures may come out of different types of presses or folders with the independent fold side of the signature on either the inboard or the outboard side of the conveyor. This means that under some conditions the signatures will be aligned by pushing the loose sheet side of the signature against the fixed plate which results in relatively poor alignment even if two pivoted joggers are employed in series.

It is an object, therefore, to provide a new and improved method and apparatus for aligning and trimming signatures which avoids one or more of the above discussed disadvantages of prior art arrangements.

It is another object of the present invention to provide a new and improved method and apparatus for aligning and trimming signatures wherein the signature stream is tightly held between opposed conveyor belt means without causing breakage of the belts when bunched up signatures occur in the stream.

It is another object of the present invention to provide a new and improved method and apparatus for aligning and trimming signatures wherein the signature stream is normally held firmly between opposed conveyor belt systems as it is trimmed but provision is made for bunched up signatures without causing breakage of the belts.

It is another object of the present invention to provide a new and improved method and apparatus for aligning and trimming signatures in which the incoming signatures are accurately aligned to a tolerance of less than $\pm 1/32$ of an inch and are firmly held in this accurately aligned position while they are trimmed.

It is another object of the present invention to provide a new and improved method and apparatus for aligning and trimming signatures wherein the edges of the signature stream are held against a fixed surface and a single cutting wheel is employed to trim each edge of the signature stream by acting against such fixed surface.

It is another object of the present invention to provide a new and improved method and apparatus for aligning and trimming signatures wherein acurate parallel cutting of the top and bottom of the signatures is achieved with a high speed flow of signatures of either light or heavy material.

It is another object of the present invention to provide a new and improved jogging apparatus for aligning the signatures in a moving stream by bodily moving a jogger plate in a direction perpendicular to the stream so that the signatures are more accurately aligned against a fixed slide plate.

It is a further object of the present invention to provide a new and improved final alignment apparatus for precisely aligning the signatures in a moving stream by gently urging the edges of the signatures into alignment by means of opposed edge mounted jogger belts which are moving at approximately the speed of the signature stream.

It is another object of the present invention to provide a new and improved final alignment apparatus for precisely aligning the signatures in a moving stream wherein the force exerted on the edge of the stream by an edge mounted jogger belt may be varied to accommodate different thicknesses of signatures and different types of paper.

Briefly considered, the arrangement of the present invention comprises a lower conveyor belt system consisting of a plurality of narrow belts spaced apart across the width of the signature stream which extend through both the alignment and trimmer sections of the apparatus. Two alignment stations are serially positioned along the lower conveyor belt system. The first alignment station comprises a fixed slide plate and a jogger plate which is moved bodily back and forth in a direction perpendicular to the conveyor belts at an adjustable rate to provide a rough alignment of the incoming stream of shingled signatures which is fed to the lower conveyor belt system. The second alignment station comprises a pair of opposed edge mounted jogger belts which are moved at an adjustable speed approximately equal to the speed of the lower conveyor belt system. One of these jogger belts may be fixedly positioned in engagement with one edge of the signature stream and the other jogger belt is lightly spring biased into engagement with the other edge of the stream so that the edges of the signatures are gently urged into precise alignment as they past the second alignment station. The positions of the fixed and spring biased belts may be interchanged to accomodate signature flows in which the independent fold side of the signature is on either the inboard or the outboard side of the lower conveyor belt system so that the signatures can always be aligned by being urged against the independent fold side of the signatures.

In accordance with an important aspect of the invention, an upper conveyor belt system is provided, consisting of a plurality of narrow belts in alignment with the belts of the lower conveyor systems, which is positioned immediately after the second alignment station and engages the top surface of the signature stream before the trailing edges of the signatures have been moved out of engagement with the jogger belts of the second alignment station so that the signatures are firmly gripped between the upper and lower conveyor belt systems for advancement to the trimmer without losing their precise alignment. The lower conveyor belt system includes a line of relatively large idler rollers which define a curved surface over which the belts of the lower conveyor system run. The upper conveyor belt system includes two lines of rollers spaced on either side of the lower belt rollers under which the belts of the upper conveyor system run, these two lines of rollers being positioned so that both the upper and lower belts are wrapped around a substantial portion of the periphery of the large rollers with the signatures gripped tightly therebetween. A pair of anvil plates are mounted on the same shaft as the large rollers but outboard of the outermost ones of the large rollers so that the peripheries of these anvil plates are positioned beneath the outer edges of the signature stream and in engagement therewith as the stream moves over the large rollers. A single cutting wheel is positioned above each anvil plate and is in engagement with a resilient insert in the periphery thereof. The cutting wheels are driven by a variable speed motor so their speed can be adjusted to accommodate different thicknesses of signatures and weights of material and trim the edges of the precisely aligned signatures while they are held against the resilient surface of the anvil plate inserts.

In accordance with a further important aspect of the invention the belts of both the upper and lower conveyor systems are individually tensioned by means of air cylinder which exert pressure on pivoted rollers in engagement with the outer surface of each belt, the tension exerted by the belts of the upper and lower systems being independently adjustable by means of separate pressure regulators. As a result, the upper belts may move away from the large rollers to accommodate bunched up signatures, the pivoted rollers in engagement with the upper belts moving against the pressure of the respective air cylinders to provide sufficient slack in the upper belts to permit such movement without breaking the belts. In a similar manner, the lower belts may move away from the respective lines of rollers on either side of the large rollers to accommodate bunched up signatures, the pivoted rollers in engagement with the lower belts moving against the pressure of the respective air cylinders to provide sufficient slack in the lower belts to permit such movement without breaking the belts. The belts of both the upper and lower conveyor systems are preferably positively driven at the speed of the incoming signature stream by means of toothed drive wheels which engage teeth on the inner surface of each belt. Since the air cylinders continue to exert pressure on the positively driven belts even though slack is produced in the belts to accomodate bunched up piles of signatures, the belts continue to grip the signatures tightly and move them in precise alignment past the cutting wheels without breaking any belts.

The invention both as to its organization and method of operation, together with further objects and advantages thereof, will best be understood by reference to the following specification taken in connection with the accompanying drawings, in which:

FIG. 8 is a sectional view taken along the line 8—8 of FIG. 1;

FIG. 9 is a sectional view taken along the line 9—9 of FIG. 8; and

FIG. 10 is a sectional view taken along the line 10—10 of FIG. 8.

Figure 1:
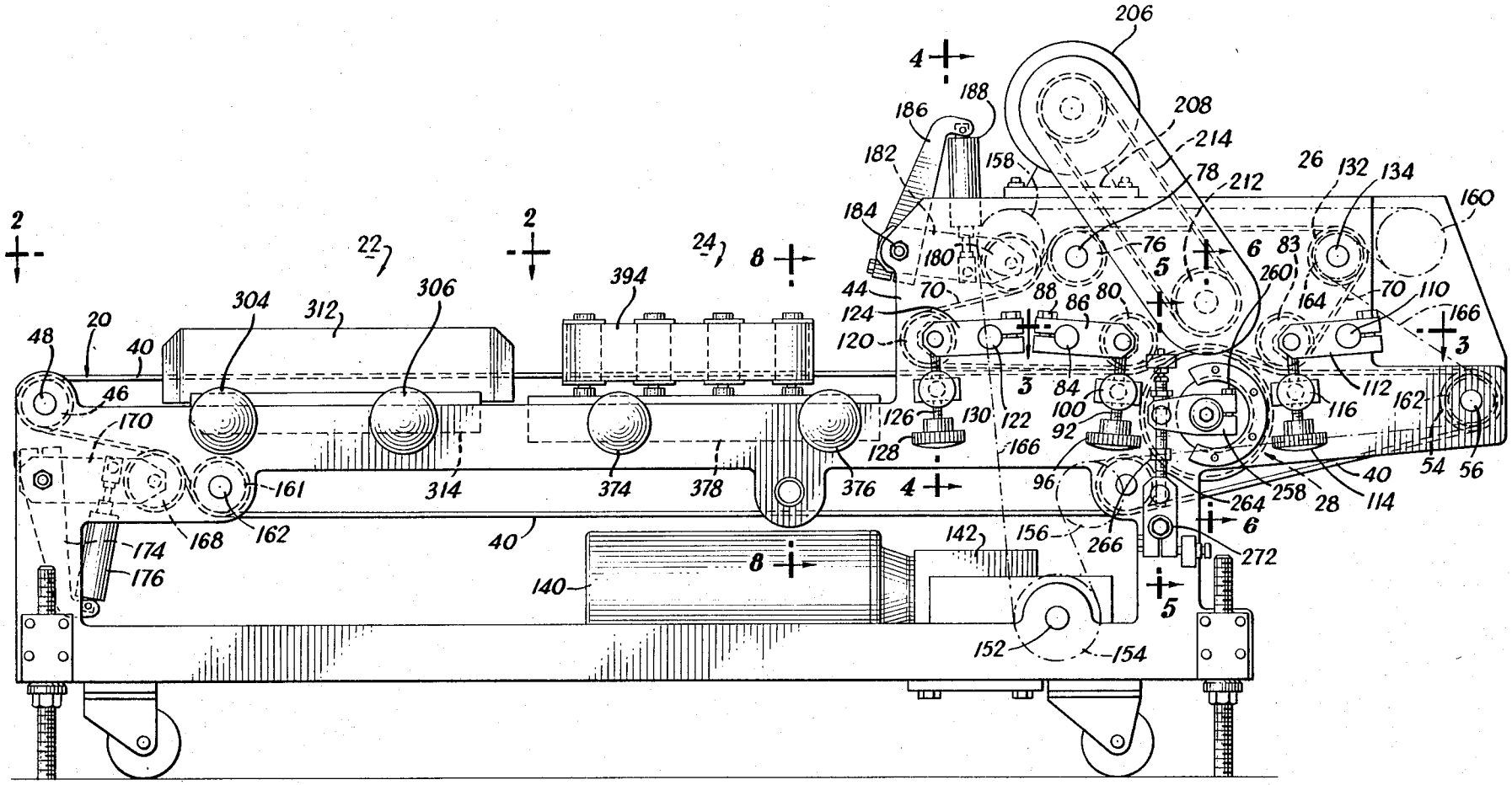
FIG. 1 is a side elevational view of an alignment and trimming apparatus embodying the features of the present invention.
Figure 2:
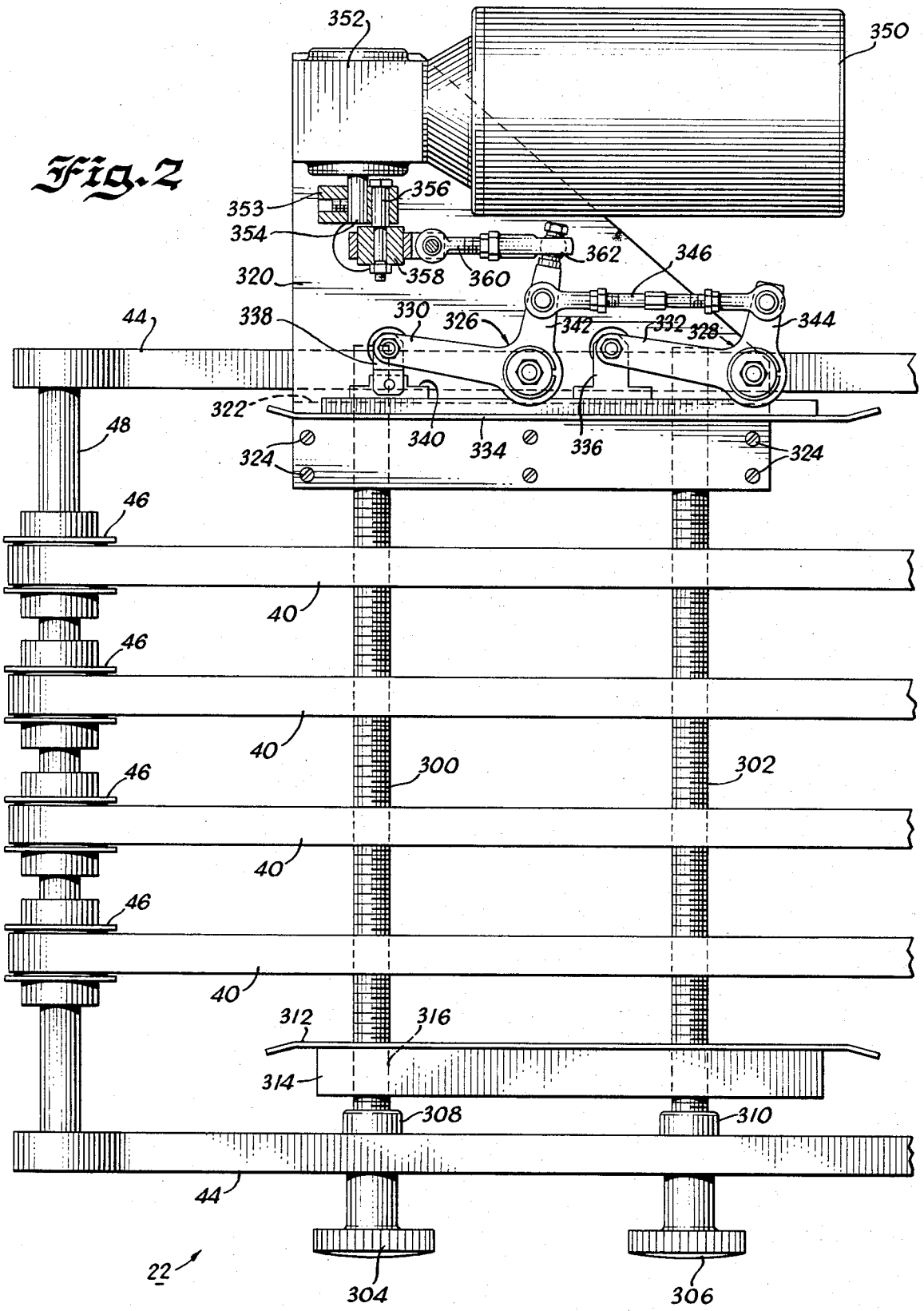
FIG. 2 is a sectional plan view taken along line 2—2 of FIG. 1.
Figure 4:
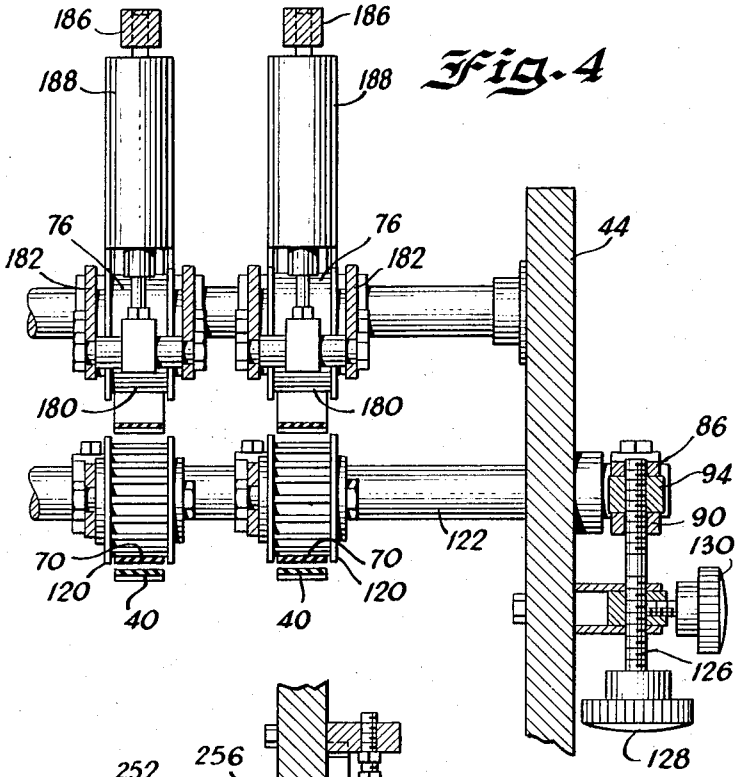
FIG. 4 is a sectional view taken along the line 4—4 of FIG. 1.
Figure 5:
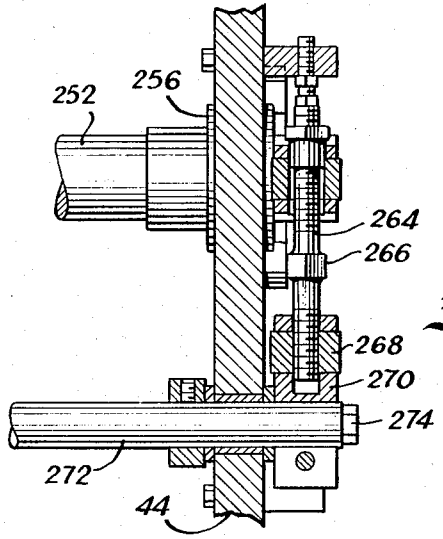
FIG. 5 is a sectional view taken along the line 5—5 of FIG. 1.
Figure 3:
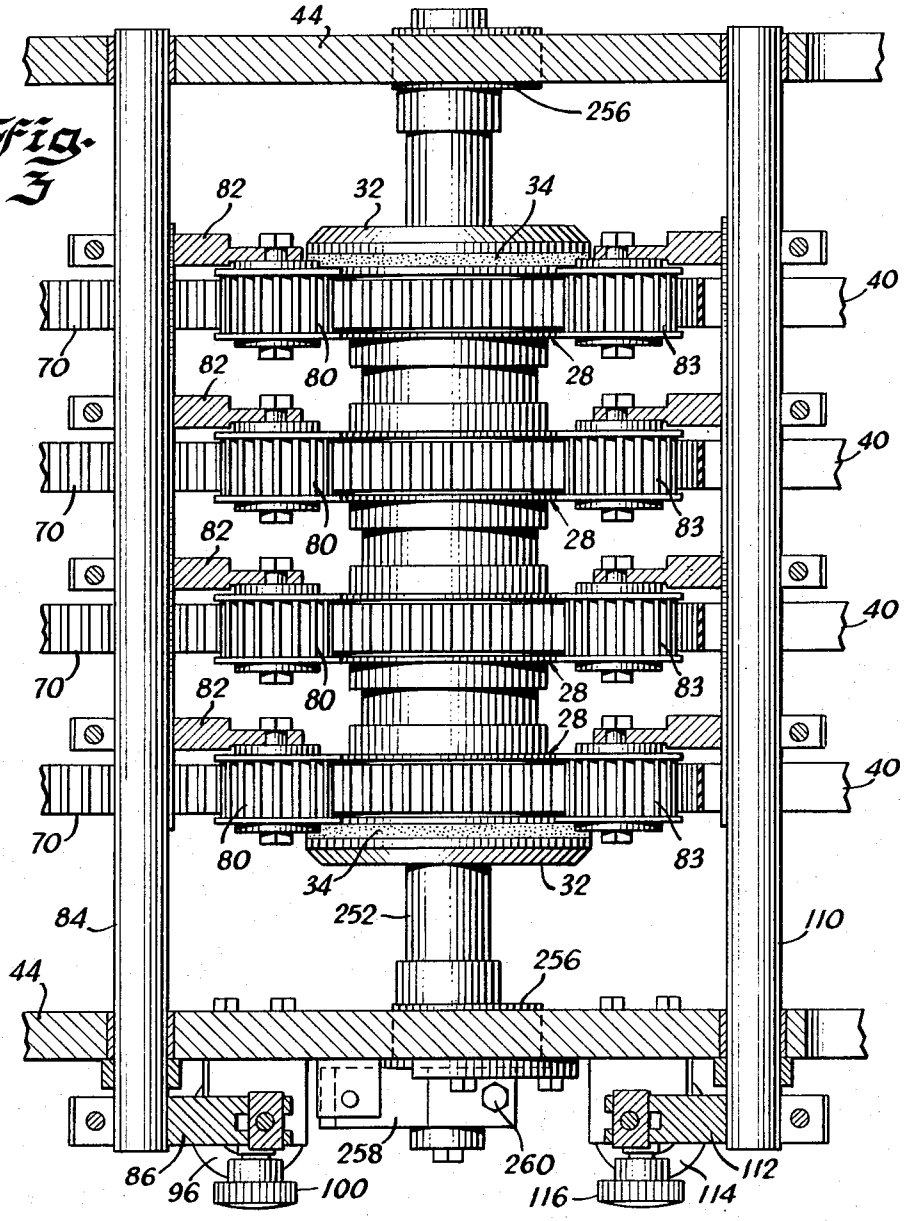
FIG. 3 is a sectional view taken along line 3—3 of FIG. 1.

Referring now to the drawings, the signature aligning and trimming apparatus of the present invention is therein illustrated as comprising a lower conveyor belt system indicated generally at 20 which is adapted to receive an incoming stream of shingled or overlapping signatures from a preceeding web press or folding apparatus. The signatures normally come from the press or folder with the splines thereof aligned in the direction of travel of the signature stream. It is necessary to reorient the folded signatures so that the spline is positioned transversely of the lower conveyor belt system 20 so that the top and bottom of these signatures can be trimmed after they have been aligned. This reorientation of the signatures so that the splines thereof are positioned transversely of the direction of movement of the conveyor 20 may be accomplished by any suitable 90° bump turn conveyor system or 90° flow turn conveyor system, as will be readily understood by those skilled in the art. It should also be noted that the signatures as they come from a conventional press or folder are overlapped approximately 1½ inches but this overlap may be varied by varying the speed of a single wide belt conveyor in the case of a bump turn 90° conveyor system, for example, so that the overlapping of the signatures may be adjusted as desired for different thicknesses of signatures. Preferrably, the incoming stream of signatures are shingled with a three inch overlap when relatively thick signatures, such as 64 sheet signatures are being trimmed in the apparatus of the present invention. In this connection, it will be understood that the lower conveyor belt system 20 is arranged to convey the incoming stream of signatures at a high rate of speed in the order of 30,000 to 40,000 signatures per hour, these signatures customarily having a size of 8½×11 inches or larger and being shingled with 1½ of signature showing in the signature stream.

The lower conveyor belt system 20 moves the incoming stream of signatures past a first alignment station indicated generally at 22 wherein the signatures are jogged laterally to provide a rough alignment of the signatures in the stream after which the signatures are conveyed to a final alignment station indicated generally at 24 wherein the edges of the signatures are engaged by edge mounted spring biased jogger belts, to be described in more detail hereinafter, for a precise alignment of the signature stream prior to the trimming operation. After the signatures have been precisely aligned by the final alignment station 24 they are engaged on their upper surface by an upper conveyor belt system indicated generally at 26 so that the signatures are gripped firmly between the lower conveyor belt system 20 and the upper conveyor belt system 26. The upper and lower conveyor systems 26, 20 with the signatures gripped firmly therebetween, are led over the large diameter rollers indicated generally at 28 in such manner that the lower conveyor belt system 20 engages the rollers 28 over a substantial portion of the periphery thereof so that the signature stream is distorted in the form of an arc as it passes over the rollers 28. As a result, the edges of the signatures are stiffened by being bent in this arc and are trimmed by means of a pair of cutting wheels, indicated generally at 30, which are positioned outboard of the conveyor systems 20 and 26 and trim the edges of the signatures as they are at the top of the arc formed by being bent over the rollers 28. The cutting blades of the cutting wheels 30 cooperate with a pair of anvil discs or plates indicated generally at 32 which are secured to the outermost ones of the large rollers 28 and are provided with resilient inserts 34 in the peripheries thereof which support the outer edges of the signature stream and provide a surface against which the cutting blades 36 of the cutting wheels 30 may act as the opposite edges of the signature stream are trimmed. After the signatures have been trimmed they exit from the upper conveyor system 26 and are conveyed by the lower conveyor system 20 to the exit end of the apparatus from which they may be conveyed to suitable stacking and bundling apparatus.

Considering now in more detail the lower conveyor belt system 20, this conveyor system comprises a series of four relatively narrow belts 40 which are spaced apart across the width of the signature stream with the outermost ones of these belts being positioned inside the edges of the signature stream. The belts 40 are provided with teeth 42 on the inner surface thereof which mesh with idler wheels which are mounted on shafts extending between the side plates 44 of the alignment and trimming apparatus of the present invention. More particularly, a first set of four toothed idler wheels 46, which are fixedly mounted in spaced apart relation along the length of a rotatable shaft 48 which is rotatably mounted in the side plates 44, are individually in engagement with the teeth 42 of the four belts 40 comprising the lower conveyor system 20. The large diameter rollers 28 which are mounted in spaced apart relation on a rotatably mounted sleeve 50 (FIG. 6) are also provided with teeth 52 which are in engagement with the teeth 42 of the belts 40. The belts 40 then extend over another series of four toothed wheels 54 which are keyed to a shaft 56 rotatably mounted between the side plates 44, the teeth of the wheels 54 being individually in engagement with the belts 42. In a similar manner, a set of toothed idler wheels 58 are keyed to the idler shaft 60 positioned above the lower flight of the conveyor system 20 with the teeth of the idler wheels 58 in individual engagement with the belts 42. A final series of four toothed idler wheels 61 are keyed to a rotatably mounted shaft 62 with the teeth of the wheels 60 in individual engagement with the belts 42.

The upper conveyor system 26 likewise comprises a series of four relatively narrow belts 70 which are spaced apart across the width of the signature stream and are in vertical alignment with the belts 42 of the lower conveyor system 20, the belts 70 being provided with teeth 72 on the inner surface thereof which engage tooth idler wheels which are rotatably mounted between the side plates 44. More particularly, a series of four toothed idler wheels 76 are keyed to the shaft 78 which is rotatably mounted between the sideplates 44 with the teeth of the wheels 76 in engagement with the teeth 72 of the belts 70.

In order to control the arc over which the lower belt system 20 engages the periphery of the large rollers 28, a first series of toothed idler wheels 80 are positioned adjacent the entrance side of the rollers 28 with the teeth of the wheels 80 in engagement with the teeth 72 of the upper belts 72 and a second series of toothed idler wheels 83 are positioned on the exit side of the rollers 28 with the teeth thereof in engagement with the teeth of the upper belts 70. Both of the series of rollers 80, 83 are individually adjustable relative to the rollers 28 so as to control the arc over which the belt systems engage the large rollers 28. Considering now the manner in which the idler wheels 80 may be adjustably positioned relative to the rollers 28, the toothed idler wheels 80 are rotatably mounted on the end of a series of arms 82 which are keyed to the shaft 84 which is rotatably mounted between the side plates 44. An actuating arm 86 is clamped to the shaft 84 outboard of the front sidewall 44 and is provided with a slot 90 within which an adjustment screw 92 is pivotally mounted by means of the threaded insert 94 rotatably mounted in the ends of the arm 86. An adjustment knob 96 is secured to the end of the screw 92 and the screw 92 is threaded through a cylindrical insert 98 so that the screw 92 can pivot to accommodate the pivotal movement of the arm 86. A locking knob 100 is provided to lock the screw 92 in its adjusted position. Accordingly, by adjustment of the knob 96 the arm 86 may be pivoted so that the shaft 84 is rotated and the position of the toothed idler wheels 80 may be varied to vary the point of engagement of the belts 40 with the rollers 28.

The idler wheels 83 are individually mounted on the ends of arms which are secured to the shaft 110 to the outboard end of which is secured the arm 112 so that the position of the rollers 83 may be adjusted by means of an adjustment knob 114 in a manner similar to that described in detail heretofore in connection with the adjustment of the idler wheels 80. After the idler wheels 83 have been adjusted in position may be locked in this position by means of the locking knob 116. The idler wheels 80 and 83 may both be adjusted in position to vary the amount of "wrap" of the belts 40 around the rollers 28 so that signatures of different materials, types and thicknesses may be accommodated. Preferably, the idler wheels 80 and 83 are adjusted to the minimum amount of wrap necessary for a particular cutting job.

At the forward end of the upper conveyor system 26 a series of toothed idler wheels 120 are provided in engagement with the teeth of the belts 70. Since the position of the idler wheels 80 is adjustable to vary the tension in the upper and lower belt systems it is desirable to also adjust the position of the forward set of toothed idler wheels 120 so that these idler wheels may be maintained level with the adjusted position of the rollers 80. Such adjustment of the idler wheels 120 is desirable to provide stability for the system and ensure that there is no deflection of the signature stream as it is engaged by the upper belt system 26 and moved to the cutting wheels 30. Adjustment of the toothed idler wheels 120 is accomplished in the same manner as that described in detail heretofore in connection with the idler wheels 80, the wheels 120 being individually mounted on arms which are secured to the shaft 122 which is rotatably mounted in the sidewalls 44. A control arm 124 is secured to the outboard end of the shaft 122 and may be adjusted in position so as to rotate the shaft 122 and hence vary the position of the idler wheels 120 by means of the adjustment screw 126 which is rotated by the knob 128. The screw 126 is locked in position by the locking knob 130.

The upper conveyor system 26 is completed by a set of four toothed drive wheels 132 which are keyed to the shaft 134 which is rotatably mounted between the sidewalls 44 of the apparatus, the teeth of the wheels 132 being individually in engagement with the belts 70 of the upper conveyor system 26.

In accordance with an important aspect of the present invention, the lower conveyor system 20 and the upper conveyor system 26 are both positively driven at the same speed. In addition, each belt is yieldingly tensioned by a separate air cylinder so that bunched up piles of signatures may be accommodated without breaking any of the belts of the system. More particularly, the shaft 134 is employed as a drive shaft for the upper conveyor system 26 and the shaft 56 is employed as a drive shaft for the lower conveyor system 20. A variable speed driving motor 140 is employed to drive, through a gear reduction box 142 a drive sprocket 144 which is positioned on the end of the output shaft 146 of the gear reduction box 142. The sprocket 144 is connected by means of the chain 148 to a main drive sprocket 150 positioned on the main drive shaft 152 which also carries a larger drive sprocket 154 which is positioned on the shaft 152 behind the rear wall 44 of the apparatus. A series of idler chain drive sprockets 156, 158 and 160 are mounted on stud shafts journalled in the rear wall of the apparatus and are positioned outboard of this rear wall. Also the shafts 56 and 134 extend rearwardly beyond the rear wall of the apparatus and have drive chain sprockets 162 and 164 secured thereto. A main drive chain 166 interconnects the main drive chain sprocket 154, the idler sprockets 156, 158 and 160 and the drive sprockets 162 and 164 on the shafts 56 and 134 so that the two conveyor belt systems 20 and 26 are positively driven at a speed determined by the variable speed driving motor 140. In this connection it will be understood that the toothed wheels secured to the shaft 56 and 134 which are individually in engagement with the teeth of each of the belts of the upper and lower conveyor systems act as positive driving means for each of the belts to ensure that all of the belts of each system move in unison and at the same speed with the belts of the other conveyor system.

In order to provide for yieldingly resilient tensioning of each belt 40 of the lower conveyor belt system 42 a series of four idler wheels 168 are individually mounted on the ends of arms 170 which in turn are pivotally mounted on a shaft 172 extending between the sidewalls 44 of the apparatus. A series of four links 174 are also pivotally mounted on the shaft 172 and an air cylinder 176 is pivotally connected between the end of each of the links 174 and the corresponding arm 170. When a predetermined air pressure is supplied to the cylinders 176 these cylinders individually pivot the arms 170 about the shaft 172 and urge the idler wheels 168 into engagement with the outer surface of the belts 40 of the lower conveyor belt system 20 so as to produce a desired tension in these belts. The tension thus produced in the belts 40 holds these belts in engagement with the respective toothed idler wheels 46, 54, 58 and 61 and also holds these belts against the periphery of the large toothed rollers 28. The tension in the lower belts 40 also functions to press the signature stream against the upper belts in the region of the idler wheels 80 and 83 so that the signatures are gripped firmly from a point well before the trimming action of the cutting wheels 30 until a point well beyond these wheels.

In order to provide yielding resilient tensioning of the belts 70 of the upper conveyor system 26 a similar series of four idler wheels 180 are pivotally mounted on the outer ends of arms 182 which are pivotally mounted on the shaft 184. A series of four links 186 are also pivotally mounted on the shaft 184 and a series of air cylinders 188 are pivotally connected between the outer ends of the links 186 and the arms 182. When a predetermined air pressure is supplied to cylinders 188 the belts 70 are individually tensioned by engagement of the idler wheels 180 with the outer surface of the belts 70. The tension thus produced in the belts 70 causes these belts to press the signature stream firmly against the lower belts 40 as the belts pass over the large rollers 28, i.e. in the region between the rollers 80 and 83 so that the signature stream is gripped firmly as the edges thereof are trimmed by the cutting wheels 30.

While the upper and lower conveyor belts systems grip the signature stream firmly during the trimming operation, it will be noted that with the arrangement of the present invention the belts are permitted to separate against the tension force exerted by the respective air cylinders in the event that a bunched up pile of signatures is present in the signature stream. Thus if a pile up of signatures occurs, the lower belt 40 can move downwardly as the pile up passes the idler wheels 120 and 180, the upper belts 70 can move upwardly against the force of the air cylinders 188 as the pile up passes over the large rollers 28, and the lower belts 40 can move downwardly against the force of the air cylinders 176 as the pile up passes under the toothed idler wheels 83. This successive slackening or yielding of the lower and upper belt systems is achieved while the belts continue to be positively driven by the chain 166 so that the signatures stream continues to be firmly held between the two belt systems and moves through the trimming section even though pile up of signatures may occur from time to time, the cushioning effect of the air cylinders 176 and 188 ensuring that abrupt increases in tension of the belts 40 and 70 to the point where the belts might break does not occur.

The tension provided by each belt system may be independently adjusted by providing separate pressure regulators to supply the air cylinders 176 and the air cylinders 188. If desired, a suitable pressure gauge may be associated with each pressure regulator so as to provide a visual indication of the pressure exerted by each set of cylinders on the respective belts of the upper and lower conveyor systems.

Considering now in more detail the operation of the cutting wheels 30 and the anvil plates 32, each of the cutting wheels 30 includes a hub portion 200 (FIG. 6) which may be adjustably secured by means of the set screw 202 to a shaft 204 which is rotatably mounted in the sidewalls 44 of the apparatus. The position of the cutting wheels 30 may thus be varied to accommodate different widths of signatures by adjusting the position of the hub 200S along the shaft 204 after which the set screws 202 are tightened.

The shaft 204 is driven by a variable speed motor 206 which is mounted on a top plate 208 extending between the sidewalls 44 of the apparatus, the motor 206 having a drive sprocket 208 positioned on the output shaft 210 thereof which is interconnected with a sprocket 212 mounted on the shaft 204 outboard of the sidewall 44 by means of the toothed timing belt 214. The speed of rotation of the cutting wheels 30 may be varied by adjusting the speed of the driving motor 206 so as to accommodate signatures of different thicknesses and different types of material as well as accommodating different rates of travel the signatures through the apparatus.

The hub portion 200 of each cutting wheel 30 is provided with a sleeve portion 216 which projects outwardly beyond the end face 218 of the hub 200 and the cutter blade 36 is provided with an annular flange portion 220 which extends outwardly and is adapted to seat on the sleeve portion 216 of the hub 200. A cutter blade clamping ring 222 is employed to hold the cuter blade 36 against the end face 218 of the hub 200 and the flange portion 220 of the blade 36 against the sleeve 216, the ring 222 being secured to the hub 200 by means of the bolts 224.

Figures 6, 7:
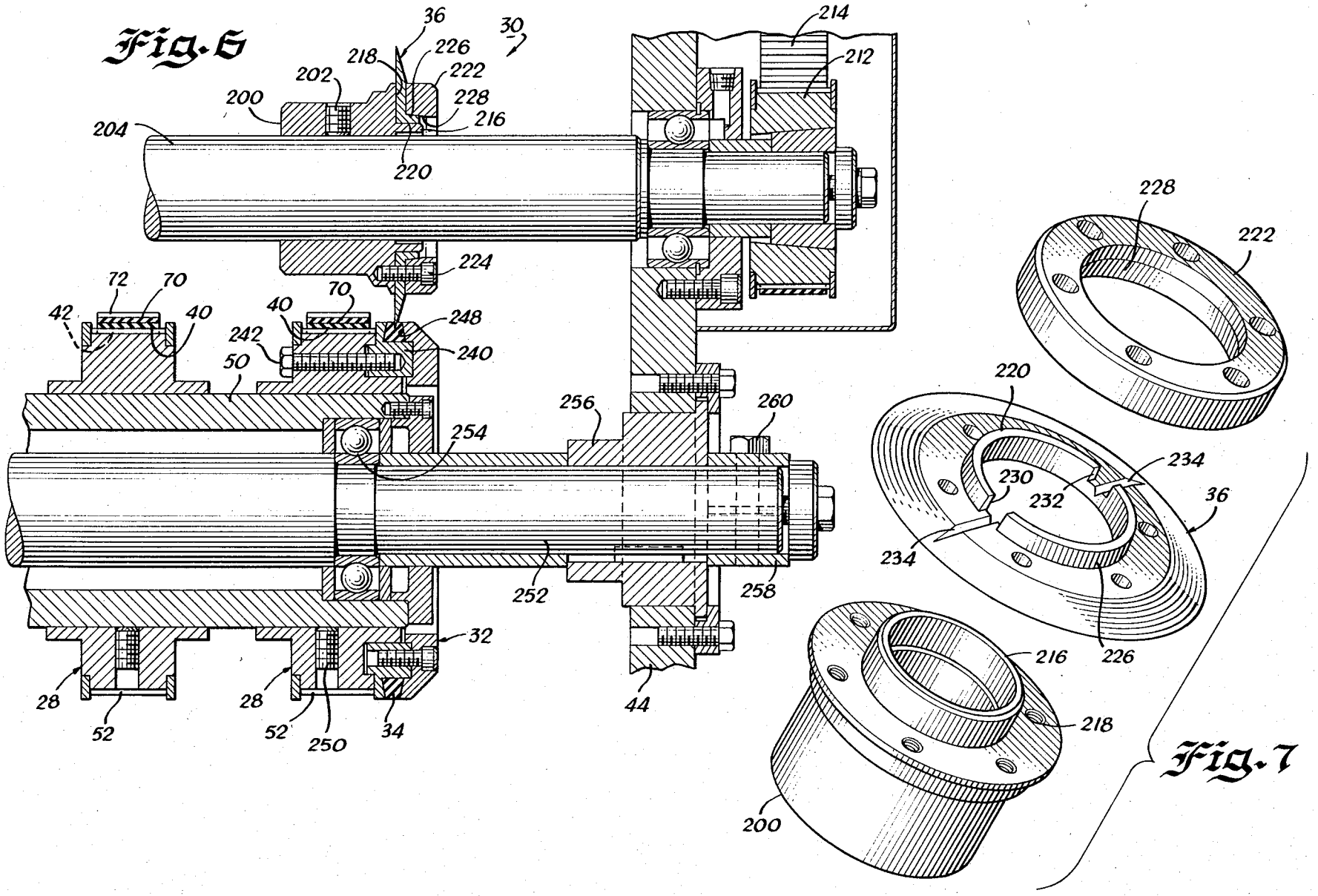
FIG. 6 is a sectional view taken along the line 6—6 of FIG. 1.
FIG. 7 is an exploded perspective view of the cutter assembly used in the apparatus of FIG. 1.

In accordance with an important aspect of the invention, the outer surface of the flange portion 220 is tapered inwardly as indicated at 226 in FIG. 6, and the ring 222 is provided with a cooperating tapered surface 228, these cooperating tapered surfaces acting to wedge the cutting blade against the end face 218 and the flange 220 thereof against the sleeve 216 when the clamping ring 222 is tightened by means of the screws 224.

In accordance with a further aspect of the invention, each cutter blade 36 of the cutting wheel 30 is made in the form of two semicircular portions so that the cutter blade 46 can be readily removed by loosening the ring 222 and removing these half sections without disassembling the entire apparatus. However, in order to provide a cutting blade 36 which does not have any notches or abrupt discontinuities where the edges of the two semicircular sections join, the cutting blade 36 is first formed with two diametrically opposed slots 230 and 232 in the annular flange portion 220 (FIG. 7) after which a deep V-shaped notch 234 is machined along a diameter which extends through the slot 230, 232, this notch being machined to a depth within 1/16 of an inch from the inside face of the blade 36. The blade 36 is then broken into two semicircular halves along the score line formed by the V-shaped notch 234 so that when the two semicircular halves are assembled on the sleeve 216 and clamped in place by the ring 222 there will be no discontinuities in the peripheral cutting edge of the cutting blade 36. In this connection it will be understood that the cutting blade 36 is made of extremely hard steel which is hardened to the point of being brittle so that the cutter blade 36 may be readily broken into two semicircular halves along the V-shaped notch 234. If these two semicircular halves were formed by cutting a slot completely through the blade 36, a notch or gap would be produced in the peripheral cutting edge of the blade 36 which would interfere with the cutting action thereof.

As discussed generally heretofore, a pair of anvil plates or discs 32 are mounted on the outboard side of the outermost ones of the large rollers 28, these anvil plates 32 being provided with resilient inserts 34 against which the peripheral edge of the cutter blades 36 act. In order to permit the removal and replacement of these resilient inserts, the anvil plates 32 are constructed in two parts. More particularly, an inner ring 240 is secured to the outer face of the outermost roller 28 by means of the bolts 242 which extend through the roller 28 and into the ring 240. An outer ring 244 is secured to the inner ring 240 by means of the bolts 246, the rings 240 and 244 being provided with cooperating surfaces which define a wedge shaped slot 248 in the periphery of the anvil plate 32 within which the resilient insert 34 is held. In accordance with a further aspect of the invention the inner ring 240, the outer ring 244 and the resilient insert 248 are all in the form of split halves so that these rings and the insert can be removed from the shaft 252. When a new resilient insert 34 is clamped in positioned in the slot 248 it will bulge out and will not provide a flat surface for the cutting blade 36. Accordingly, after the rings 240 and 244 are removed from the machine they are reassembled on a suitable grinding wheel jig fixture with the new insert 34 positioned in the slot 248. The outer surface of the insert is then ground down to provide a flat surface which is from 0.005 to 0.007 inches above the peripheries of the steel rings 240 and 244. After the new insert has thus been ground flat, the rings 240 and 240 are removed from the jig fixture and reassembled around the shaft 252 on the large roller 28 with the ground insert in place in the slot 248.

Each of the large rollers 28 is secured to the sleeve 50 by means of a set screw 250 and the sleeve 50 is rotatably mounted on a shaft 252 by means of the bearings 254 which are positioned between the shaft 252 and the sleeve 50 at either end of the sleeve 50. In order to adjust the position of the anvil plates 32 vertically relative to the cutter blades 36, the shaft 252 is mounted in and keyed to a pair of eccentric sleeves 256 which are rotatably mounted in the sidewalls 44. The shaft 252 extends outwardly beyond the forward wall 44 of the apparatus and a control arm 258 is connected to this outboard end by means of the bolt 260. A cylindrical insert 262 is rotatably mounted in the bifurcated outer end of the control arm 258 and is threaded to receive an adjustment screw 264 which extends vertically and is provided with a hexagonal nut portion 266 integral therewith by means of which the screw 264 may be adjusted to move the outer end of the control arm 258 up or down. The bottom end of the adjustment screw 264 is threaded into a cylindrical insert 268 which is rotatably mounted in the bifurcated upper end of a block 270 the lower end of which is rotatably mounted on a stub shaft 272 which is mounted in the front sidewall 44 of the apparatus. After the screw 264 has been rotated so that the anvil plates 32 are moved vertically to the desired position, the block 270 is locked in the adjusted position by means of the nut 274 so that the adjusted position of the anvil plates is securely maintained. The maximum vertical movement of the anvil plates 32 which is achieved by pivoting the arm 258 and rotating the eccentrics 256 is preferrably about ⅛ inch which is sufficient to accommodate changes in the diameter of the cutting blades 36 as they are sharpened periodically during usage.

Considering now the details of the first alignment station 22, a pair of rods 300 and 302 are arranged to extend between the sidewalls 44 of the apparatus, the adjustment hand wheels 304 and 306 being secured to the outboard ends of these rods and the rods held laterally by means of the set screw collars 308 and 310, respectively. A vertically extending side plate 312 is secured to a bar 314 which is slidably mounted on the bar 302 and is provided with a threaded aperture 316 which receives a threaded portion of the bar 300. Accordingly, adjustment of the hand wheel 304 is effective to move the sideplate 312 to a desired fixed position relative to the inboard edge of the signature stream which is conveyed along the lower conveyor belt system 20. On the far side of the conveyor belt system 20 a base plate 320 is secured to a bar 322 positioned beneath the plate 320 and secured thereto by means of the screws 324, the bar being slideably mounted on the unthreaded rear portion of the rod 300 and having a threaded aperture adapted to receive the threaded rear end portion of the rod 302. Accordingly, as the hand wheel 306 is rotated the base plate 322 may be moved laterally relative to the outboard edge of the signature stream.

A pair of bell cranks 326 and 328 are rotatably mounted on the base plate 320 and the arms 330 and 332 of the bell cranks 326, 328 are pivotally connected to a moveable jogger sideplate 334. More particularly, the arm 332 is pivotally connected to a block 336 secured to the back side of the moveable jogger plate 334 and the arm 330 is pivotally connected to a link 338 which is in turn pivotally mounted in a block 340 secured to the moveable jogger plate 334. The arms 342 and 344 of the bell cranks 326 and 328 are interconnected by means of an adjustment screw 346 so that the moveable jogger plate 334 may be tilted at an angle relative to the edge of the signature stream. However, preferrably the screw 346 is adjusted so that the plate 334 is moved bodily in a direction perpendicular to the direction of travel of the conveyor 40 for most alignment operations.

A variable speed motor 350 is mounted on the base plate 320 and drives a gear reduction box 352 which provides an approximately 5:1 reduction in the speed of the motor 350. A hub 352 is mounted on the output shaft 354 of the gear box 350, the hub 352 having a pin 356 extending therefrom which is eccentrically mounted relative to the shaft 354. A block 358 is rotatably mounted on the pin 356 and has a bifurcated end section in which is pivotally mounted the rod 360. The rod 360 is interconnected with the outer end of the bell crank arm 342 through a ball joint connection 362. Accordingly, when the motor 350 is energized the rod 360 is reciprocated and rotates the bell cranks 326 and 328 back and forth in unison so that the moveable jogger plate 334 is moved in a direction perpendicular to the signature stream and periodically engages the outboard edge thereof and urges it against the fixed slide plate 312. If the motor 350 is driven at a speed of 1750 r.p.m. and the reduction box 352 provides a reduction of 5:1, the moveable jogger plate 334 will strike each signature in a signature stream moving at a speed of 30,000 signatures per hour 6½ times as the signature moves by the first alignment station 22.

Referring now in more detail to the final alignment station 24, a pair of rods 370 and 372 extend transversely of the belts 40 and are mounted in the sidewalls 44 of the apparatus, the rods 370 and 372 having the adjustment wheels 374 and 376 on the inboard end thereof. The hand wheel 374 is employed to adjust the lateral position of a first base plate assembly 378 positioned on the inboard side of the belts 40 and the hand wheel 376 is employed to adjust the lateral position of a second base plate assembly 380 which is positioned behind the outboard edge of the belts 40. Each of the base plate assemblies 378 and 380 is substantially identical. The assembly 378 includes an upper plate 382 which is slideably mounted on the base plate assembly by means to be described in detail hereinafter and has a vertical drive shaft 384 rotatably mounted therein and a plurality of fixed axle rods 386, 388 and 390 extending upwardly therefrom and secured thereto. A toothed drive wheel 391 is secured to the drive shaft 384 and toothed rollers 392 are rotatably mounted on each of the shafts 386, 388 and 390. A jogger belt 394 having teeth on the inside surface thereof is mounted edgewise on the rollers 392 and drive wheel 391. In order to adjust the tension in the belt 394 and hold it against the rollers 392, a vertically extending arcuate plate 396 is adjustably positioned on the plate 382 by means of the adjustment screw 398, the plate 396 engaging the toothed inner surface of the belt 394 and holding it away from the rollers mounted on the shafts 386 and 388 so that the belt 394 is tensioned against the opposite side of these rollers and against the drive wheel 391. It will be noted that the front roller mounted on the shaft 390 is spaced outwardly from the edge of the signature stream whereas the rollers positioned on the shafts 384, 386 and 388 are parallel to the edge of the signature stream. With this arrangement an open throat is provided for the final alignment station 24 so that the edges of the signatures are gently urged into alignment as they pass through the station 24, as will be described in more detail hereinafter.

The base assembly 380 likewise includes an upper sideable plate 400 on which is rotatably mounted the drive shaft 402 and the fixed shafts 404, 406 and 408 on which toothed wheels are mounted so as to drive the endless belt 410. An adjustable tensioning plate 412 is provided to hold the belt 410 against the rollers mounted on the shafts 402, 404 and 406, it being noted that the shaft 408 is positioned outwardly beyond the edge of the signature stream by approximately 1 inch to provide the above described open throat feature.

The base asembly 378 may be adjusted laterally of the signature stream by means of the hand wheel 374, the rod 370 being threaded in the area of the base assembly 378 to accomplish such movement and the rod 372 being unthreaded in this area to provide a guideway for sliding movement of the base assembly 378. In a similar manner the base assembly 380 may be adjusted laterally of the signature stream by adjustment of the hand wheel 376, the rod 372 being threaded in the area of the base assembly 380 and the rod 370 being unthreaded in this area to act as a guide means therefor.

In order to drive the shafts 384 and 402 so that the belts 394 and 410 are moved in the direction of the signature stream and at the same speed at the signature stream, a variable speed motor 420 is mounted on the back side of the rear sidewall 44 of the apparatus and is arranged to drive through a gear reduction box 422 a transversely extending shaft 424 which is positioned below the base assemblies 378 and 380. Preferably the output shaft 426 of the gear reduction box 422 is connected to a coupling 428 and the other end of the shaft 424 is mounted in a bearing 430 in the front sidewall 44.

Considering first the manner in which the drive shaft 402 of the rear base assembly 380 is driven from the shaft 424, the shaft 424 is provided with a key 432 which drives a bevel gear 434 arranged to slide along the the shaft 424. The bevelled gear 434 drives a meshing bevelled gear 436 which is mounted on a vertically extending stub shaft 438 which is rotatably mounted in the base assembly 380 and extends downwardly therefrom. A first timing sprocket 440 is secured to the shaft 438 above the gear 436 and drives a timing chain 442. An idler timing sprocket 444 is rotatably mounted on a stubshaft 446 which extends downwardly from the base assembly 380. The drive shaft 402, which is rotatably mounted in the upper slide plate 400, extends downwardly through a clearance opening 448 in the base assembly 380 and has a small timing sprocket 450 secured to the bottom end thereof. The timing sprocket 450 is positioned in engagement with the timing chain 442, as shown in FIG. 10, so that the toothed drive wheel 452 which is secured to the shaft 402 above the slide plate 400 drives the belt 410 in the same direction as the conveyor system 20.

In order to permit lateral movement of the base assembly 380 on the rods 370 and 372 by adjustment of the hand wheel 376 while maintaining the desired driving engagement between the shaft 424 and the drive shaft 402, a bracket 454 which is mounted on the underside of the base assembly 380 extends downwardly adjacent the rear face of the bevelled gear 434 and is provided with an offset leg portion 456 which is positioned adjacent the other face of the bevelled gear 434. Accordingly, when the base assembly 380 is moved laterally the bracket 454 engages the bevel gear 434 and slides it along the key 432 so that a driving relationship between the bevel gears 434 and 436 is maintained, it being understood that the above described lateral adjustment of the base assembly 380 is accomplished when the motor 420 is deenergized.

While the base assembly 380 may be adjusted laterally to position the belt 410 adjacent the back edge of the signature stream, it is also desirable to resiliently urge this belt into engagement with the edge of the signature stream to provide precise alignment of the signatures. To this end, the slide plate 400 is slidably mounted on the base assembly 380 by providing the single ball inserts 460 which are pressed into the plate 400, the single balls of these inserts riding in corresponding elongated grooves 462 formed in the upper surface in the base assembly 380. The grooves 462 extend perpendicularly to the direction of movement of the conveyor so as to ensure that the plate 400 is slideably mounted for limited lateral movement, in the order of ½ inch, relative to the base plate 380 in a direction perpendicular to the edge of the signature stream. As shown in FIG. 10, the timing sprocket 450 is arranged to engage the timing chain 442 so that any reaction forces on the plate 400 are in a direction away from the edge of the signature stream. These reaction forces are overcome and in addition a slight inward biasing force is provided for the upper plate 400, and hence the belt 410, by means of a series of spring arms 464 which are secured to a rear flange 466 of the base assembly 300 and engage the rear edge of the slide plate 400 and resiliently urge it inward against the reaction force of the timing chain 442 so that the belt 410 is resiliently urged inwardly against the edge of the signature stream as it is driven in the direction of this stream by the toothed drive wheel secured to the drive shaft 402.

As discussed previously, the base assembly 378 on the other side of the conveyor system 20 is also arranged to be moved laterally by adjustment of the hand wheel 374. However, in order to accommodate large variations in the width of the signature stream, such as occur when double parallel type signatures are to be trimmed, a relatively long key 470 is provided on the shaft 424 to accommodate such movement. A bevelled gear 472, similar to the bevel gear 434, is slideably mounted on the shaft 424 and is driven by the key 470, this bevelled gear being in mesh with a bevelled gear 474 connected to the bottom end of a stubshaft 476 which is rotatably mounted in the base plate assembly 378 and carries the timing sprocket 478 secured thereto. A bracket 480 is connected to the bottom surface of the base assembly 378 and is positioned on either side of the hub portion of the bevelled gear 472 so that this gear is moved along the length of the shaft 424 as the base plate assembly 378 is adjusted laterally relative to the signature stream by movement of the handwheel 374. An idler sprocket 482 is rotatably mounted on a stub shaft 484 which extends from the bottom of the base assembly 378, a timing chain 486 being driven by the sprocket 478 and driving a small timing sprocket 488 positioned on the bottom end of the drive shaft 384 which is rotatably mounted in the upper slide plate 382 of the assembly 378. It will be noted that rotation of the shaft 424 drives the shaft 476 in a direction opposite to the direction of rotation of the shaft 438 in the assembly 380 so that the belt 394 is driven in the same direction as the belt 410 of the assembly 380.

The top plate 382 is slideably mounted on the upper surface of the base assembly 378 be means of the single ball inserts 490 in a manner identical to that described in detail heretofore in connection with the plate 400. Also, the plate 382 is urged inwardly against the reaction force of the drive sprocket 488 by means of the spring arms 492, again in a manner similar to that described in connection with the assembly 380. Accordingly, the belt 394 is resiliently urged with a light spring force against the inboard edge of the signature stream so as to provide precise alignment of these signatures as they pass between the belts 394 and 410.

Although both of the top plates 382 and 400 are arranged to be resiliently urged against the edge of the signature stream, only one of these plates is so biased at a particular time, the other plate being locked in position so that its jogger belt acts as a movable but unyielding surface against which the other resiliently biased jogger belt may urge the signatures. More particularly, each of the plates 382 and 400 is arranged to be locked in position against the respective base assembly by means of the set screws 496 which extends through slots in the top plates 382 or 400 and into the upper surface of the respective base plate. The screws 496 of one of the plates 382 or 400 are tightened to lock that plate in a desired adjusted position relative to its baseplate so that the spring force of the spring arms 464 or 492 is no longer effective to move that plate. With such an arrangement either one of the plates 382 or 400 may be locked in fixed position, depending upon the position of the independent fold side of the signatures in the stream of signatures supplied to the apparatus. In the opposite assembly, the screws 496 are loosened so that they permit limited movement of the top plate in response to the spring force of the arms 464 or 492 so that the corresponding jogger belt is resiliently urged against one edge of the signature stream and urges the signatures against a fixedly positioned but moving jogger belt of the opposite assembly. In this connection it will be understood that the speed of the motor 420 is preferably variable over a range such that the jogger belts 394 and 410 move at a speed of from 80% to 120% of the speed of the conveyor to accommodate different types and thicknesses of signatures and to obtain optimum conditions for the precise alignment of a particular stream of signatures.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A signature trimmer for trimming the edge of an incoming stream of overlapping signatures comprising, first conveyor belt means adapted to engage the upper surface of a continuous stream of overlapping signatures, second conveyor belt means adapted to engage the bottom surface of said continuous stream of overlapping signatures, fluid pressure means for exerting a force on said first and second belt means in the direction to cause said first and second belt means firmly to grip said stream of overlapping signatures while permitting the tension in said belts to be reduced when bunched up signatures occur in said stream, and cutting means positioned to trim at least one edge of said stream of overlapping signature while the same is firmly held between said first and second belt means.

2. A signature trimmer, as set forth in claim 1, wherein said first and second belt means each comprise a series of belts spaced apart across the width of said stream of signatures.

3. A signature trimmer, as set forth in claim 1, which includes means for positively driving said first and second conveyor belt means at the same speed.

4. A signature trimmer as set forth in claim 1, which includes means for driving said first and second belt means at the same speed as said incoming stream of signatures.

5. A signature trimmer as set forth in claim 2, wherein each belt in said series is provided with teeth on the side thereof opposite the side in engagement with said signatures, and drive means for each of said series of belts and engaging the teeth thereof.

6. A signature trimmer as set forth in claim 5, wherein said drive means for both of said series of belts are driven from a common power source.

7. A signature trimmer as set forth in claim 1, wherein said cutting means comprises a pair of cutting wheels positioned to engage the opposite edges of said stream of signatures as the same is firmly held between said first and second belt means.

8. A signature trimmer as set forth in claim 7, which includes a pair of discs positioned to engage the edges of said stream of signatures beneath said cutting wheels and cooperating with said cutting wheels to effect trimming of said edge.

9. A signature trimmer as set forth in claim 8, wherein each of said discs have a resilient insert in the edge thereof against which the edge of the respective cutting wheel bears as it trims the edge of the stream of signatures.

10. A signature trimmer as set forth in claim 7, which includes variable speed drive means for rotating said pair of cutting wheels.

11. A signature trimmer as set forth in claim 10, wherein said cutting wheels are mounted in spaced apart relation on a rotary shaft which is rotated by said variable speed drive means.

12. A signature trimmer as set forth in claim 11, wherein each of said cutting wheels comprises a hub portion fixedly mounted on said shaft, a flat circular cutting blade having a cutting edge on the periphery thereof, and a blade clamping ring for securing said cutting blade to said hub.

13. A signature trimmer as set forth in claim 12 wherein said cutting blade comprises two semicircular portions which are held in cooperative alignment on said hub by said blade clamping ring.

14. A signature trimmer as set forth in claim 12, wherein said hub portion has a sleeve portion projecting from one end face thereof, said cutting blade being held against said end face and having a projecting flange portion which is held against said sleeve by said blade clamping ring.

15. A signature trimmer as set forth in claim 14, wherein the outer surface of said flange portion of said cutting blade is tapered inwardly and said clamping ring has a cooperating tapered inner surface to clamp said cutting blade securely against said end face and said sleeve portion when said ring is secured to said hub.

16. A signature trimmer as set forth in claim 14, wherein said flange portion of said cutting blade and said clamping ring have cooperating surfaces which operate to clamp said cutting blade securely against said end face and said sleeve portion when said ring is secured to said hub.

17. A signature trimmer as set forth in claim 8, which includes means for adjusting the position of said discs relative to said cutting wheels.

18. A signature trimmer for trimming the edge of an incoming stream of overlapping signatures comprising a first series of spaced apart relatively narrow endless belts, means for feeding an incoming stream of overlapping signitures onto the upper surface of said first series of belts, means defining an arcuate surface over which said first series of belts pass, a second series of endless belts in alignment with said first series of belts over at least a portion of the travel thereof and positioned to engage the top surface of said signature stream and tightly hold the same against said first series of belts as said first series of belts pass over said arcuate surface, and cutting means positioned to trim at least one edge of said stream of overlapping signatures while the same passes over said arcuate surface.

19. A signature trimmer as set forth in claim 18, wherein said arcuate surface comprises a series of rollers one for each belt of said first series, said series of rollers being coaxially aligned and in engagement with the inside of said first series of endless belts.

20. A signature trimmer as set forth in claim 19, wherein said rollers are of relatively large diameter, and means for guiding said first series of belts so that they engage said rollers over a substantial portion of the periphery thereof.

21. A signature trimmer as set forth in claim 20, wherein said guide means comprises idler wheel means positioned on either side of said rollers and in engagement with the inside of said second series of endless belts.

22. A signature trimmer as set forth in claim 21, which includes means for adjusting the position of said idler wheel means so as to vary the tension in said second series of belts.

23. A signature trimmer as set forth in claim 18, wherein said cutting means comprises a pair of cutting wheels rotatably mounted adjacent said arcuate surface and adapted to engage the opposite edges of said stream of signatures as the same passes over said arcuate surface.

24. A signature trimmer as set forth in claim 19, wherein said cutting means comprises a pair of cutting wheels rotatably mounted above said coaxially aligned rollers and positioned to engage the opposite edges of said stream of signatures as the same passes over said rollers.

25. A signature trimmer as set forth in claim 24, wherein said series of rollers are spaced inwardly from the outside edges of said signature stream, and anvil means associated with the outermost ones of said series of rollers and positioned beneath the outside edges of said signature stream to provide surfaces against which the edges of said cutting wheels may bear in trimming the edges of said signature stream.

26. A signature trimmer as set forth in claim 25, wherein said anvil means comprises a disc secured to the outer face of each of the outermost rollers in said series, and a resilient insert positioned in the edge of each of said discs and cooperating with the respective one of said cutting wheels.

27. A signature trimmer for trimming the edges of an incoming stream of overlapping signatures comprising, a first series of endless belts spaced apart across the width of said incoming stream, said belts having teeth on the inside surfaces thereof, a first plurality of groups of aligned toothed first idler wheels for individually supporting said first series of belts in a generally horizontal run, one group of aligned first idler wheels providing a raised portion intermediate the ends of said horizontal run, means for feeding a stream of overlapping signature onto said horizontal run, a second series of endless belts having teeth on the inside surfaces thereof, a second plurality of group of aligned toothed idler wheels for individually supporting said second series of belts for movement in closely spaced alignment with said first series of belts, first and second groups of said second idler wheels being aligned on either side of said one group of aligned first idler wheels which are so positioned relative thereto that said second series of belts holds said stream of overlapping signatures firmly against said first series of belts in said raised portion of said horizontal run, and cutting means positioned to trim at least one edge of said stream of overlapping signatures while the same is in said raised portion of said horizontal run.

28. A signature trimmer as set forth in claim 27, which includes means for adjusting the position of said first group of aligned second idler wheels relative to said one group of aligned first idler wheels, thereby to vary the tension in said first and second series of belts.

29. A signature trimmer as set forth in claim 27, which includes means for adjusting the position of said second group of aligned second idler wheels relative to said one group of aligned first idler wheels, thereby to vary the tension in said first and second series of belts.

30. A signature trimmer as set forth in claim 27, a third group of aligned second idler wheels positioned along said horizontal run ahead of said raised portion, and means for adjusting the position of said third group of second idler wheels in a direction generally normal to said horizontal run, thereby to adjust the spacing between said first and second series of belts ahead of said raised portion of said horizontal run.

31. A signature trimmer as set forth in claim 27, which includes a plurality of aligned rollers individually in engagement with the outer surface of said second series of belts, means pivotally mounting said plurality of aligned rollers for movement in unison in a direction to change the tension in said second series of belts, and fluid pressure means for exerting a predetermined force on said aligned plurality of rollers, thereby to provide a predetermined tension in said second series of belts.

32. A signature trimmer as set forth in claim 27, which includes a shaft, a plurality of rollers pivotally mounted on said shaft and individually in engagement with the outer surface of said second series of belts, and air cylinder means for exerting a pressure on said rollers in a direction to produce a predetermined tension in said second series of belts.

33. A signature trimmer as set forth in claim 32, wherein each of said rollers is rotatably mounted on a lever which is pivotally mounted on said shaft, and said air cylinder means comprises a plurality of air cylinders individually connected to said levers for individually biasing the associated roller into engagement with one of said belts.

34. A signature trimmer as set forth in claim 32, which includes means for varying the pressure exerted on said rollers by said air cylinder means.

35. A signature trimmer as set forth in claim 33, which includes means common to said plurality of air cylinders for varying the pressure exerted thereby on said rollers.

36. A signature trimmer as set forth in claim 27, which includes a plurality of aligned rollers individually in engagement with the outer surface of said first series of belts, means pivotally mounting said plurality of aligned rollers for movement in unison in a direction to change the tension in said first series of belts, and fluid pressure means for exerting a predetermined force on said aligned plurality of rollers, thereby to provide a predetermined tension in said first series of belts.

37. A signature trimmer as set forth in claim 36, which includes a shaft, a plurality of rollers pivotally mounted on said shaft and individually in engagement with the outer surface of said first series of belts, and air cylinder means for exerting a pressure on said rollers in a direction to produce a predetermined tension in said first series of belts.

38. A signature trimmer as set forth in claim 37, wherein each of said rollers is rotatably mounted on a lever which is pivotally mounted on said shaft, and said air cylinder means comprises a plurality of air cylinders individually connected to said levers for individually biasing the associated roller into engagement with one of said belts.

39. A signature trimmer as set forth in claim 37, which includes means for varying the pressure exerted on said rollers by said air cylinder means.

40. Apparatus for aligning and trimming an incoming stream of overlapping signatures comprising, conveyor belt means having a substantially horizontal run portion, means for feeding a stream of overlapping signatures to said horizontal run conveyor portion, first jogger means positioned along said horizontal run portion for roughly aligning said stream of overlapping signatures, final alignment means positioned along said horizontal run portion downstream of said first jogger means for precisely aligning said stream of overlapping signatures, means positioned downstream of said final alignment means for pressing the stream of finally aligned signatures firmly against said conveyor belt means, and cutting means positioned to trim at least one edge of said finally aligned signatures while the same are firmly held against said conveyor belt means by said last named means.

41. Apparatus as set forth in claim 40, wherein said first jogger means comprises a first side plate fixedly positioned to engage one edge of said stream of overlapping signatures, a second side plate positioned adjacent the other edge of said stream of overlapping signatures, and means for bodily moving said second side plate back and forth in a direction perpendicular to said stream of signatures so that said stream is periodically struck by said second side plate and moved laterally against said first side plate.

42. Apparatus as set forth in claim 41, wherein said second side plate is maintained parallel to said other edge of said stream while bodily moving in said direction.

43. Apparatus as set forth in claim 41, wherein said second side plate is moved back and forth at a rate such that it strikes each signature in said stream a number of times.

44. Apparatus as set forth in claim 41, which includes a pair of bell cranks, means interconnecting said bell cranks so that they move in unison, means pivotally connecting one arm of each bell crank to said second side plate at spaced apart points therealong so that rotation of said bell cranks produces translatory motion of said second side plate in said direction, and reciprocating drive means connected to the other arm of one of said bell cranks for moving said second side plate back and forth in said direction.

45. Apparatus as set forth in claim 41, which includes means for adjusting the position of one bell crank relative to the other so that said second side plate may be positioned at an angle to the edge of said stream.

46. Apparatus as set forth in claim 41, which includes means for varying the extent of movement of said second side plate in said direction.

47. Apparatus as set forth in claim 40, wherein said final alignment means comprises a pair of opposed endless jogger belts mounted on edge on either side of said stream for movement in the direction of flow of said stream, means for positioning one of said belts in fixed relation to one edge of said stream of overlapping signatures, means for driving said endless belts in the direction of flow of said stream and at the speed of said conveyor belt means, means for resiliently positioning the other of said belts to engage the other edge of said stream and resiliently urge said signatures against said one belt as said signatures are moved past said pair of jogger belts by said conveyor belt means.

48. Apparatus as set forth in claim 47, which includes means for varying the pressure said other belt exerts on said other edge of said stream to resiliently urge said signatures against said one belt.

49. Apparatus as set forth in claim 47, wherein said belts are spaced further apart at the entry side of said signature stream to accommodate misaligned signatures in said stream.

50. Apparatus as set forth in claim 47, wherein said belts are arranged to move parallel to the edges of said signature stream at the exit side thereof and are spaced farther apart at the entry side to accommodate misaligned signatures in said stream.

51. The method of trimming the edges of a continuous stream of overlapping signatures, which comprises the steps of, depositing the incoming stream of overlapping signatures onto a conveyor consisting of a plurality of first narrow belts spaced apart across the width of said stream, engaging the top surface of said stream with a plurality of second narrow belts in vertical alignment with said first belts, moving said first and second belts over an arcuate surface with said signatures gripped firmly therebetween, and trimming at least one edge of said stream of overlapping signatures while the same is moving over said arcuate surface.

52. The method of claim 51, which includes the step of individually tensioning each of said first and second belts.

53. The method of claim 52, wherein individual tensioning of said first and second belts is provided by air cylinders associated with each belt.

54. The method of claim 53, which includes the step of varying the tension in said belts by adjusting the air pressure supplied to said air cylinders.

55. The method of claim 52, which includes the step of varying the tension in at least some of said first and second belts to accommodate variations in said stream of overlapping signatures.

56. The method of claim 51, which includes the step of individually releasably tensioning each of said first and second belts, thereby to accommodate pile ups in said signature stream without breaking said belts.

* * * * *